US008266758B2

(12) United States Patent
Hoffman et al.

(10) Patent No.: US 8,266,758 B2
(45) Date of Patent: Sep. 18, 2012

(54) ADJUSTABLE SPATULA FOR FORMING A SMOOTHLY ARCUATE CONCAVE CONTOUR IN A VISCOUS MATERIAL AND A SMOOTHLY ARCUATE CONVEX CONTOUR IN THE VISCOUS MATERIAL

(76) Inventors: Bernard S. Hoffman, Port Jefferson Station, NY (US); William J. Romanoff, Setauket, NY (US); Scott C. Romanoff, Middle Island, NY (US)

( * ) Notice: Subject to any disclaimer, the term of this patent is extended or adjusted under 35 U.S.C. 154(b) by 1158 days.

(21) Appl. No.: 12/152,590

(22) Filed: May 15, 2008

(65) Prior Publication Data

US 2009/0282635 A1 Nov. 19, 2009

(51) Int. Cl.
*B05C 17/10* (2006.01)

(52) U.S. Cl. ..... 15/235.8

(58) Field of Classification Search ..... 15/235.7, 15/235.8; 425/87, 458
See application file for complete search history.

(56) References Cited

U.S. PATENT DOCUMENTS

| | | | | | |
|---|---|---|---|---|---|
| 952,971 | A | * | 3/1910 | Wolary | 15/235.8 |
| 1,067,301 | A | * | 7/1913 | Bricker | 15/235.8 |
| 1,083,099 | A | | 12/1913 | Howg | |
| 1,743,704 | A | | 1/1930 | Boux | |
| 2,127,176 | A | * | 8/1938 | Kroecker | 407/29.11 |
| 2,143,063 | A | * | 1/1939 | Fetterolf | 407/29.11 |
| 2,608,853 | A | | 9/1952 | Schrepper | 72/136 |
| 2,968,057 | A | | 1/1961 | Pratt | 15/236 |
| 3,123,947 | A | * | 3/1964 | Rawley | 451/495 |
| 3,710,467 | A | * | 1/1973 | Coon et al. | 407/29.11 |
| 4,130,269 | A | | 12/1978 | Schreyer | 254/67 |
| 4,263,704 | A | * | 4/1981 | Myers et al. | 407/29.15 |
| 4,496,500 | A | | 1/1985 | Haber | 264/36 |
| 4,631,019 | A | | 12/1986 | House | 425/458 |
| 4,669,970 | A | | 6/1987 | Perry | 425/458 |
| 4,757,572 | A | | 7/1988 | Yon | 15/235.7 |
| 5,192,558 | A | | 3/1993 | Sparrow et al. | 425/87 |
| 5,467,497 | A | | 11/1995 | Greene et al. | 15/235.8 |
| 5,544,384 | A | | 8/1996 | Forselius et al. | 15/235.7 |
| 5,611,102 | A | | 3/1997 | Lesinsky et al. | 15/235.5 |
| 5,700,187 | A | * | 12/1997 | Balbi | 451/495 |
| 5,774,924 | A | | 7/1998 | Beckham et al. | 15/235.7 |
| 5,792,489 | A | | 8/1998 | Liberman | 425/458 |
| 5,947,803 | A | * | 9/1999 | Gruner | 451/354 |
| 6,003,192 | A | | 12/1999 | Ciminise et al. | 15/235.5 |
| 6,494,771 | B2 | * | 12/2002 | Carlson | 451/344 |
| 7,048,618 | B1 | * | 5/2006 | Cramer | 451/59 |
| 7,131,902 | B2 | * | 11/2006 | Hope | 451/533 |

* cited by examiner

*Primary Examiner* — Randall Chin
(74) *Attorney, Agent, or Firm* — Bernard S. Hoffman

(57) ABSTRACT

An adjustable spatula for forming a smoothly arcuate concave contour in a viscous material and a smoothly arcuate convex contour in the viscous material, independently of each other, with a certainty that the contour of the viscous material is consistent, and with using only one hand. The adjustable spatula includes a blade, a handle, and an apparatus. The handle extends from the blade and is gripped by a user. The apparatus bends the blade to form the blade into a smoothly arcuate convex contour to form the smoothly arcuate concave contour in the viscous material and bends the blade to form the blade into a smoothly arcuate concave contour to form the smoothly arcuate convex contour in the viscous material, independently of each other, without a need for the user to have to manually bend the blade, with the certainty that the contour of the viscous material is consistent, and with using only the one hand.

15 Claims, 6 Drawing Sheets

ADJUSTABLE SPATULA FOR FORMING A SMOOTHLY ARCUATE CONCAVE CONTOUR IN A VISCOUS MATERIAL AND A SMOOTHLY ARCUATE CONVEX CONTOUR IN THE VISCOUS MATERIAL

1. BACKGROUND OF THE INVENTION

A. Field of the Invention

The embodiments of the present invention relate to a spatula, and more particularly, the embodiments of the present invention relate to an adjustable spatula for forming a smoothly arcuate concave contour in a viscous material and a smoothly arcuate convex contour in the viscous material, independently of each other, with a certainty that the contour of the viscous material is consistent, and with using only one hand.

B. Description of the Prior Art

Plaster walls have been traditionally constructed by a labor-intensive process. A common wall requires the application of three individual plaster layers, each of which must be leveled and set prior to the application of the succeeding layer. Although considerable skill is required to achieve a flat and smooth surface over a large area, the end result is a wall having an unmistakable look and feel, along with superior sound insulation properties.

The use of this skilled labor runs counter to the present trends in the commercial and home construction industry. Emphasis today is on speed, efficiency, and cost-effectiveness towards the completion and profitability of construction projects. Competitive bidding pressures have made it increasingly difficult to rely on anything other than unskilled labor when bidding a construction project.

Except for the most expensive of custom installations, gypsum wall board—also know as "dry wall"—has completely replaced plaster in the construction of walls and ceilings in modern homes and offices. Composed of a core of calcined gypsum, starch, water, and foam slurry sandwiched between special paper faces, gypsum board or dry wall retains the fire-resistant characteristics of gypsum plaster but can be installed with much less labor and by less skilled workers. In addition, the use of dry wall brings very little "water" into a job, and thereby eliminates some of the waiting required with the curing and drying of gypsum plaster.

After the core material has hardened and bonded to the paper faces, the dry wall is cut to length, heated to drive off any residual moisture, and then bundled for shipping. For the majority of commercial and home construction applications, the dry wall is cut into rectangular sheets of four feet by eight-to-twelve feet, and is one-half inch to five-eighths inch in thickness. Installation of the dry wall can occur over either steel or wood studs using self-tapping screws for metal studs and either screws or nails to fasten the dry wall to the wood support. After installation of the dry wall is complete, all of the joints between the boards and the indentations left by the nailing or screw attachments must be filled and smoothed before the surface of the dry wall is ready for final texturing or finishing.

The majority of dry wall panels used in finished wall constructions have a tapered edge to assist in forming a flush and invisible seam between adjacent panels when the joint finishing operation is completed. Finishing begins by the troweling of a layer of joint compound or plaster into the tapered edge joint formed along adjacent edges of adjoining dry wall panels. A paper or glass fiber reinforcing tape is then placed over the joint and covered with an additional layer of the joint compound. These first layers are allowed to dry, and one or two finishing coats of the joint compound are then applied and sanded. A properly finished joint forms a wall appearing to be made of a solid sheet rather than discrete panels.

Flat gypsum board also can be used to form curved surfaces. When the curves are gentle, dry wall can conform to a large radius by simply bending the panels around a curving line of support studs. For somewhat sharper curves, the paper faces of the wall board can be moistened, which decreases the stiffness of the board prior to conforming it to the shapes required upon its installation. Drying causes the dry wall to again stiffen, permitting its attachment to the underlying support structure.

In custom and semi-custom residential construction, there has been a recent trend towards providing visual features, such as rounded walls, recesses, columns, and bay window areas. In commercial buildings, the trend has been toward providing one or more "walls as art" located in the "common" areas. In each of these construction applications, there are framing irregularities, creases, and/or gaps that are created when attaching the flat dry wall materials to the supportive radius wall framing.

The majority of these features require radii that are very difficult to achieve by simply deforming the flat dry wall panels. Instead, the present practice is to cut the dry wall into multiple sections that are then pieced together to create a substantially curved surface. A smoothed and finished surface is then obtained by the application of either the joint compound or a plaster material to cover the joint irregularities. The multi-piece surface is thereby formed into a visually-continuous surface having multiple-curved surfaces expressed therein.

Achieving, however, this uniformly radiused finish has proven to be extraordinarily difficult for the dry wall laborers to achieve. In addition to requiring a higher level of skill on the part of the workman, it has proven necessary to devise specialized tools to assist the dry wall installers in obtaining the desired surface uniformity. Workmen have frequently resorted to reshaping their trowels to approximate the working edges to the desired surface radius. Other workmen have attempted to maintain the required curvature by utilizing a bent piece of cardboard.

Neither of these solutions have proven to be particularly desirable. The modified trowel must be held at a specific angle relative to the dry wall surface throughout the finishing process. This includes maintaining the angle along the entire length of a specific and curved wall feature. Also, to maintain continuity from one curvature to another, this same angle must be carefully repeated. With respect to the use of cardboard, these improvised tools are not capable of uniformly maintaining an appropriate curvature. Consequently, it has proven to be extraordinarily difficult to maintain a fixed angular position between the improvised tool and the work surface.

Thus, there exists a need for an adjustable spatula for forming a smoothly arcuate concave contour in a viscous material and a smoothly arcuate convex contour in the viscous material, independently of each other, with a certainty that the contour of the viscous material is consistent, and with using only one hand.

Numerous innovations for spatulas have been provided in the prior art, which will be described below in chronological order to show advancement in the art, and which are incorporated herein by reference thereto. Even though these innovations may be suitable for the specific individual purposes to which they address, however, they differ from the present invention in that they do not teach an adjustable spatula for forming a smoothly arcuate concave contour in a viscous material and a smoothly arcuate convex contour in the viscous material, independently of each other, with a certainty that the contour of the viscous material is consistent, and with using only one hand.

(1) U.S. Pat. No. 1,083,099 to Howg.

U.S. Pat. No. 1,083,099 issued to Howg on Dec. 30, 1913 teaches a trowel including a plate, standards fixed to the plate in spaced relation to each other and having spaced ears, a rod pivotally connected to one pair of ears, an adjusting nut swivelly connected to the other pair of ears and in threaded engagement with the rod, and a handle carried by the stem.

(2) U.S. Pat. No. 1,743,704 to Boux.

U.S. Pat. No. 1,743,704 issued to Boux on Jan. 14, 1930 teaches a plasterer's dressing plane for finishing off angles and corners of molded surfaces, which includes a smooth faced member of flexible character, and back apparatus to which the member is secured, whereby it is stayed in set contour. The back apparatus includes a train of back pieces to whose remote ends of the member are attached and which form intermediate back stays.

(3) U.S. Pat. No. 2,608,853 to Schrepper.

U.S. Pat. No. 2,608,853 issued to Schrepper on Sep. 2, 1952 in class 72 and subclass 136 teaches a corner forming tool including an elongated substantially V-shaped member including a pair of sloping side walls having inner edges joined together, a pair of elongated wall sections integrally formed with the outer edges of the side walls and inclined relative to the side walls, a substantially V-shaped deflector having a pair of sloping walls joined with the side walls of the member and having inner joined edges inclined relative to the joined inner edges of the side walls, and an adjustable connection between the elongated wall sections for adjusting the wall sections relative to each other and to the side walls.

(4) U.S. Pat. No. 2,968,057 to Pratt.

U.S. Pat. No. 2,968,057 issued to Pratt on Jan. 17, 1961 in class 15 and subclass 236 teaches a contour knife including a flat and flexible member having a first straight end, a second smaller end, two tapering sides connecting the ends, and apparatus to curve the member including a clamp connected to the two sides. The clamp includes a hollow and tubular member notched on one end to fit the edges of the flexible member, and a threaded bolt passing through the tubular member. The smaller end is curved and adapted to fit in the palm of the hand. A molded lip is on the smaller end to facilitate holding in the hand.

(5) U.S. Pat. No. 4,130,269 to Schreyer.

U.S. Pat. No. 4,130,269 issued to Schreyer on Dec. 19, 1978 in class 254 and subclass 67 teaches a ratchet-type telescopic load binder having axially and oppositely moveable first and second threaded screw members of different diameters. The larger diameter member includes an axial and cylindrical void into which the smaller screw member is permitted to move. Greater reach is achieved by providing the smaller member with a screw thread pitch and a thread length being greater than those of the larger member. The cylindrical void of the larger member extends past its operative thread length to accommodate increased penetration of the smaller member.

(6) U.S. Pat. No. 4,496,500 to Haber.

U.S. Pat. No. 4,496,500 issued to Haber on Jan. 29, 1985 in class 264 and subclass 36 teaches a method for shaping a motor vehicle panel. Body filler material is applied to a damaged area of a panel and allowed to harden partially. Using back and forth strokes, a saw-toothed blade is used to shape the partially hardened material to the desired contour. The blade should be flexible to allow the user to bend it to the shape of the panel.

(7) U.S. Pat. No. 4,631,019 to House.

U.S. Pat. No. 4,631,019 issued to House on Dec. 23, 1986 in class 425 and subclass 458 teaches a flat, quadrilateral, and resilient spreader member, symmetrical about its longitudinal axis, has mutually convergent longitudinal edges, and has handle members removably attachable along its longitudinal edges for bending the spreader member while being used in the application and shaping of moldable material to a workpiece.

(8) U.S. Pat. No. 4,669,970 to Perry.

U.S. Pat. No. 4,669,970 issued to Perry on Jun. 2, 1987 in class 425 and subclass 458 teaches an adjustable hand-tool for finishing corners, edges, and the like with cementious material to effect a uniformly rounded configuration to the corner. The hand tool includes a backing plate having a forward working edge characterized by an indented central portion and forwardly extending legs forming a first obtuse angle. Overlaying the backing plate is a pliable sheet having a forward working edge characterized by an indented central portion and forwardly extending legs forming a second obtuse angle that is larger than the first obtuse angle, so that the working edge of the pliable sheet extends beyond the working edge of the backing plate. The backing plate is preferably manually bendable to suit an individual craftsman and to obtain a working region having cooperating curvatures at the working edge of the backing plate, at the working edge of the pliable sheet, and as caused by the bend.

(9) U.S. Pat. No. 4,757,572 to Yon.

U.S. Pat. No. 4,757,572 issued to Yon on Jul. 19, 1988 in class 15 and subclass 235.7 teaches a hand finishing tool for dry wall board installation, which includes three operative components. A main body including a planar sheet material is formed into two substantially flat sides extending radially from the common line to define a dihedral configuration, a manual tool gripping apparatus pinned at its stem end to the inner surface of the main body, and a tool angle biasing apparatus adapted upon digital manipulation to outwardly bias the flat sides to temporarily enlarge during tool use the angle that the sides normally define.

(10) U.S. Pat. No. 5,192,558 to Sparrow et al.

U.S. Pat. No. 5,192,558 issued to Sparrow et al. on Mar. 9, 1993 in class 425 and subclass 87 teaches a plaster's tool having a flexible blade with a handle coupled to a member for dynamically folding the blade, so that the tool may be manipulated and the blade dynamically folded by a person holding the handle to assume the correct angular configuration for laying a plaster bead along the outside corner formed by the juncture of two surfaces meeting at an angle of 180° or greater. The blade readily assumes a flat and planar configuration providing easier loading of plaster onto the tool and the transfer of the plaster on the flat blade to the work surface.

(11) U.S. Pat. No. 5,467,497 to Greene et al.

U.S. Pat. No. 5,467,497 issued to Greene et al. on Nov. 21, 1995 in class 15 and subclass 235.8 teaches an adjustable drywall corner tool, including a pair of work-engaging blades normally disposed substantially at a 90° angle to one another. A hinge extends between mating edges of the blades. A structure is for changing the angle between the two blades, so that the blades will fit in an inside corner of more or less than the 90° angle. A handle extends from the angle changing structure, so that a person can grip the handle to apply taping to the corner.

(12) U.S. Pat. No. 5,544,384 to Forselius et al.

U.S. Pat. No. 5,544,384 issued to Forselius et al. on Aug. 13, 1996 in class 15 and subclass 235.7 teaches a wall corner finishing tool including a pair of plastic blades connected by a living hinge. The proximal ends of a pair of arcuate arms are hingeably connected to the back sides of the blades. The arms are curved toward each other so as to overlap at their intersection. The arms include longitudinal openings extending therethrough. A handle is attached to the intersection of the arms by a screw extended through the openings and into one end of the handle. When the screw is loosened, the arms move toward or away from each other to adjust the angle between the blades. When the blades are positioned at a desired angle, the screw is tightened to fix them in position. The blades can be adjusted for finishing wall corners of a great variety of angles.

(13) U.S. Pat. No. 5,611,102 to Lesinsky et al.

U.S. Pat. No. 5,611,102 issued to Lesinsky et al. on Mar. 18, 1997 in class 15 and subclass 235.5 teaches a tool for applying a viscous material to a curved surface, which includes a thin, flexible, and planar blade having first and second side edges, and first and second elongate handles depending from the blade. The first and second handles are attached to the blade near the first and second side edges, respectively, and are configured to be manually grasped by a user of the tool.

(14) U.S. Pat. No. 5,774,924 to Beckham et al.

U.S. Pat. No. 5,774,924 issued to Beckham et al. on Jul. 7, 1998 in class and subclass 235.7 teaches a cornering tool used for application of drywall or plaster or similar construction coating materials. The tool is adjustable over a wide range of corner angles. In addition, the adjustability allows for use in plastering as well as drywall application where the angle is offset to effect screeding of excess coating material. The tool includes a thinned hinge section with increased flexibility allowing for angular adjustment of the blades without bending the blades out of plane. The tool is preferably formed of plastic.

(15) U.S. Pat. No. 5,792,489 to Liberman.

U.S. Pat. No. 5,792,489 issued to Liberman on Aug. 11, 1998 in class 425 and subclass 458 teaches a tool for spreading bonding compound simultaneously on two planar surfaces intersecting along a common border. The tool includes a wedge-shaped applicator having first and second applicator blades meeting at a substantially right angle along a linear vertex. The blades extend away from the vertex and terminate at opposite lateral sides. The wedge-shaped applicator has an interior portion defined within the substantially right angle. Also included is a handle for gripping the tool and connected to proximal ends of the blades. The blades have forward edges disposed opposite the proximal ends, with the forward edges having outside surfaces to facilitate application of the bonding compound. A flexible applicator strip is disposed along a portion of the forward edges. The first and second applicator blades each have a bent corner causing the outside surfaces of the forward edges to bend forward in a direction away from the interior portion of the applicator blade. The bent corner causes the flexible applicator strip to bend therewith forming a bent flexible contour, so that the flexible contour assumes a substantially linear shape when forced into contact with the planar surfaces and advanced along the planar surfaces by the handle.

(16) U.S. Pat. No. 6,003,192 to Ciminise et al.

U.S. Pat. No. 6,003,192 issued to Ciminise et al. on Dec. 21, 1999 in class 15 and subclass 235.5 teaches, as shown in FIGS. 1 and 2, which are, respectively, a diagrammatic perspective view of a typical prior art tool being used to form an arcuate surface in a viscous material, and an enlarged diagrammatic front elevational view of the area generally enclosed by the dotted curve identified by ARROW 2 in FIG. 1 of the typical prior art tool, a typical prior art hand tool 20 includes a flexible blade 22 having a working edge 24 for use with a cementitious material 26 for permitting forming and finishing of a column 28 and other curved surfaces of relatively large radii. A pair of gripping surfaces 30 are formed in the flexible blade 22, which include handles 32 to which handgrips 34 are attached. To enhance ability of a user 36 to control curvature of the working edge 24 of the flexible blade 22, the handgrips 34 are attached to the handles 32 in a manner so that a portion of each handgrip 34 overlies, and is supported by, an outer lateral portion 38 of an associated handle 32. This arrangement permits the user 36 to apply force through the handgrips 34 directly to an outer periphery 40 of the flexible blade 22. The typical prior art hand tool 20 requires a need for the user 36 to have to manually bend the flexible blade 22 and hold it bent throughout its operation by the two hands of the user 36, thereby eliminating a certainty that the contour of the viscous material is consistent throughout the operation.

It is apparent that numerous innovations for spatulas have been provided in the prior art that are adapted to be used. Furthermore, even though these innovations may be suitable for the specific individual purposes to which they address, however, they would not be suitable for the purposes of the embodiments of the present invention as heretofore described, namely, an adjustable spatula for forming a smoothly arcuate concave contour in a viscous material and a smoothly arcuate convex contour in the viscous material, independently of each other, with a certainty that the contour of the viscous material is consistent, and with using only one hand.

2. SUMMARY OF THE INVENTION

Thus, an object of the embodiments of the present invention is to provide an adjustable spatula for forming a smoothly arcuate concave contour in a viscous material and a smoothly arcuate convex contour in the viscous material, independently of each other, with a certainty that the contour of the viscous material is consistent, and with using only one hand, which avoids the disadvantages of the prior art.

Briefly stated, another object of the embodiments of the present invention is to provide an adjustable spatula for forming a smoothly arcuate concave contour in a viscous material and a smoothly arcuate convex contour in the viscous material, independently of each other, with a certainty that the contour of the viscous material is consistent, and with using only one hand. The adjustable spatula includes a blade, a handle, and an apparatus. The handle extends from the blade and is gripped by a user. The apparatus bends the blade to form the blade into a smoothly arcuate convex contour to form the smoothly arcuate concave contour in the viscous material and bends the blade to form the blade into a smoothly arcuate concave contour to form the smoothly arcuate convex contour in the viscous material, independently of each other, without a need for the user to have to manually bend the blade, with the certainty that the contour of the viscous material is consistent, and with using only the one hand.

The novel features considered characteristic of the embodiments of the present invention are set forth in the appended claims. The embodiments of the present invention themselves, however, both as to their construction and their method of operation together with additional objects and advantages thereof will be best understood from the following description of the specific embodiments when read and understood in connection with the accompanying drawing.

3. BRIEF DESCRIPTION OF THE DRAWING

The figures of the drawing are briefly described as follows.

4. LIST OF REFERENCE NUMERALS UTILIZED IN THE DRAWING

Figure 1:
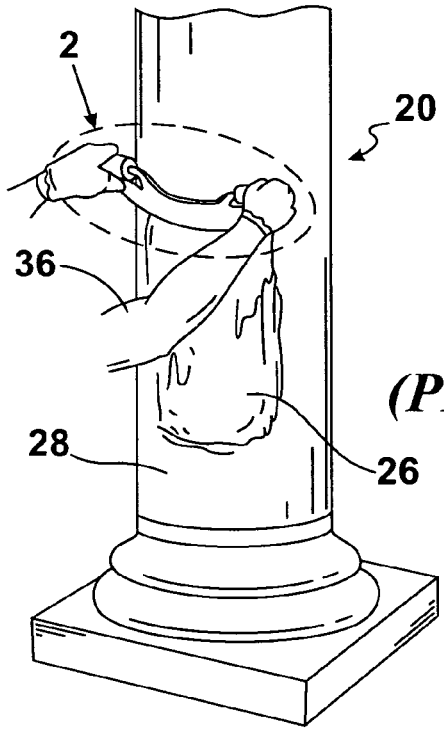
FIG. 1 (PRIOR ART)
FIG. 1 is a diagrammatic perspective view of a typical prior art tool being used to form an arcuate surface in a viscous material.
Figure 2:
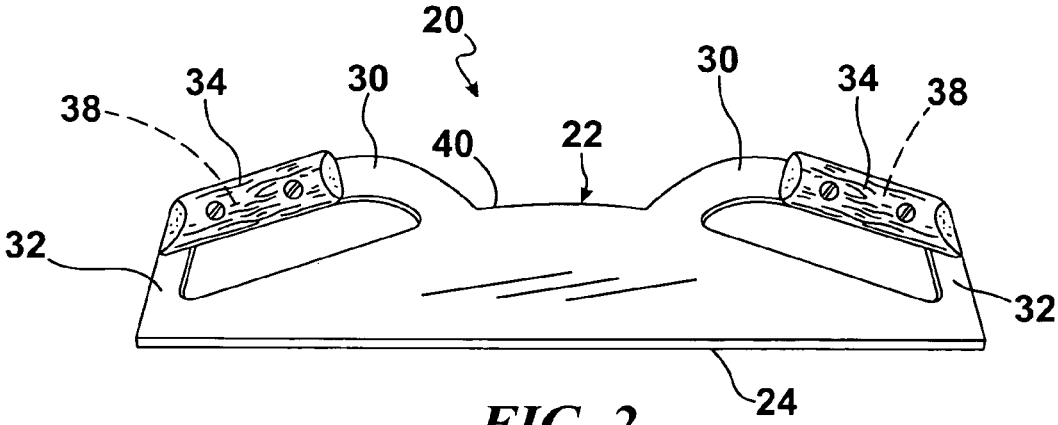
FIG. 2 (PRIOR ART)
FIG. 2 is an enlarged diagrammatic front elevational view of the area generally enclosed by the dotted curve identified by ARROW 2 in FIG. 1 of the typical prior art tool.

A. Prior Art.

20 typical prior art hand tool

22 flexible blade

24 working edge of flexible blade 22 for use with cementitious material 26 for permitting forming and finishing of column 28 and other curved surfaces of relatively large radii

26 cementitious material

28 column

30 pair of gripping surfaces of flexible blade 22

32 handles of pair of gripping surfaces 30 of flexible blade 22

34 handgrips

36 user

38 outer lateral portion of associated handle of handles 32 of pair of gripping surfaces of flexible blade 22

40 outer periphery of flexible blade 22

B. General.

50 adjustable spatula of embodiments of present invention 50 for forming smoothly arcuate concave contour in viscous material 52 and smoothly arcuate convex contour in viscous material 52, independently of each other, with certainty that contour of viscous material 52 is consistent, and with using only one hand of user 36

52 viscous material

53 one hand

C. Overall Configuration of Adjustable Spatula 50.

54 blade

56 handle for gripping by a user 60

58 apparatus for bending the blade 54 into a smoothly arcuate convex contour for forming the smoothly arcuate concave contour in the viscous material 52 and for bending the blade 54 into a smoothly arcuate concave contour for forming the smoothly arcuate convex contour in the viscous material 52, independently of each other, without a need for the user 60 to have to manually bend the blade 54, with certainty that contour of viscous material 52 is consistent, and with using only one hand 53 of user 60

60 user

D. Specific Configuration of First Embodiment of Apparatus 70.

70 apparatus

72 turnbuckle

74 sleeve of turnbuckle 72

76 pair of threaded rods of turnbuckle 72

78 ends of pair of threaded rods 76 of turnbuckle 72

80 devises of ends 78 of pair of threaded rods 76 of turnbuckle 72

82 pins

84 half-laps of ends 78 of pair of threaded rods 76 of turnbuckle 72

86 pins

E. Specific Configuration of Second Embodiment of Apparatus 90.

90 apparatus

92 ratchet

94 head of ratchet 92

96 pawl of head 94 of ratchet 92

98 handle of ratchet 92

100 arrow

F. Specific Configuration of Third Embodiment of the Apparatus 110.

110 apparatus

112 motor

114 power interface for holding at least one battery 115 for powering motor 112

115 at least one battery for powering motor 112

116 armature of motor 112

118 pair of ends of armature 116 of motor 112

120 pair of threaded rods

122 pair of internally threaded sleeves

124 ends of pair of internally threaded sleeves 120

126 at least one switch

128 thumb of user 60

G. Specific Configuration of Fourth Embodiment of Apparatus 130.

130 apparatus

132 motor
134 power interface for holding at least one battery 135 for powering motor 132
135 at least one battery for powering motor 132
136 armature of motor 132
138 pair of ends of armature 136 of motor 132
140 pair of threaded rods
142 pair of rods
144 pair of cross members
145 inner ends of pair of rods 142
146 outer ends of pair of rods 142
148 at least one switch

5. DETAILED DESCRIPTION OF THE PREFERRED EMBODIMENTS

A. General

Figure 3:
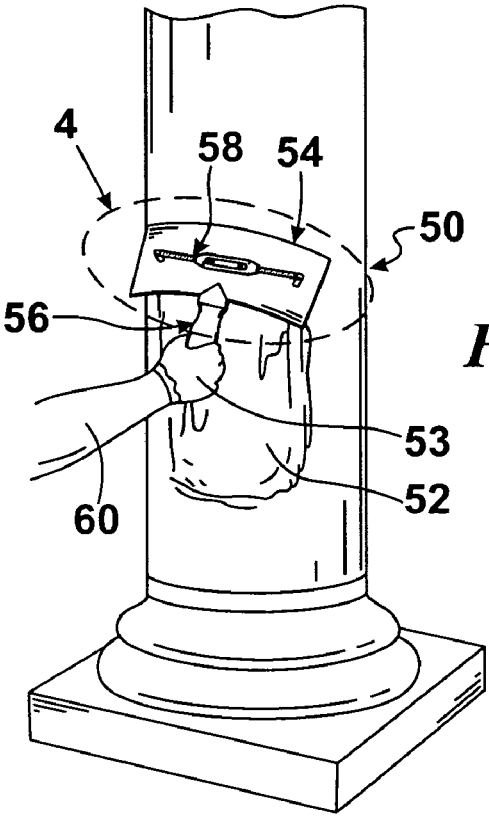
FIG. 3 is a diagrammatic perspective view of a first embodiment of the adjustable spatula of the present invention forming a smoothly arcuate convex contour in a viscous material.

Referring flow to the figures, in which like numerals indicate like parts, and particularly to FIG. 3, which is a diagrammatic perspective view of a first embodiment of the adjustable spatula of the present invention forming a smoothly arcuate convex contour in a viscous material, the adjustable spatula of the embodiments of the present invention is shown generally at 50 for forming a smoothly arcuate concave contour in a viscous material 52 and a smoothly arcuate convex contour in the viscous material 52, independently of each other, with a certainty that the contour of the viscous material 52 is consistent, and with using only one hand 53.

B. The Overall Configuration of the Adjustable Spatula 50

The adjustable spatula 50 comprises a blade 54, a handle 56, and an apparatus 58. The handle 56 extends from the blade 54 and is for gripping by a user 60. The apparatus 58 is for bending the blade 54 into a smoothly arcuate convex contour for forming the smoothly arcuate concave contour in the viscous material 52 and for bending the blade 54 into a smoothly arcuate concave contour for forming the smoothly arcuate convex contour in the viscous material 52, independently of each other, without a need for the user 60 to have to manually bend the blade 54, with the certainty that the contour of the viscous material 52 is consistent, and with using only the one hand 53 of the user 60.

C. The Specific Configuration of a First Embodiment of the Apparatus 70

Figure 4:
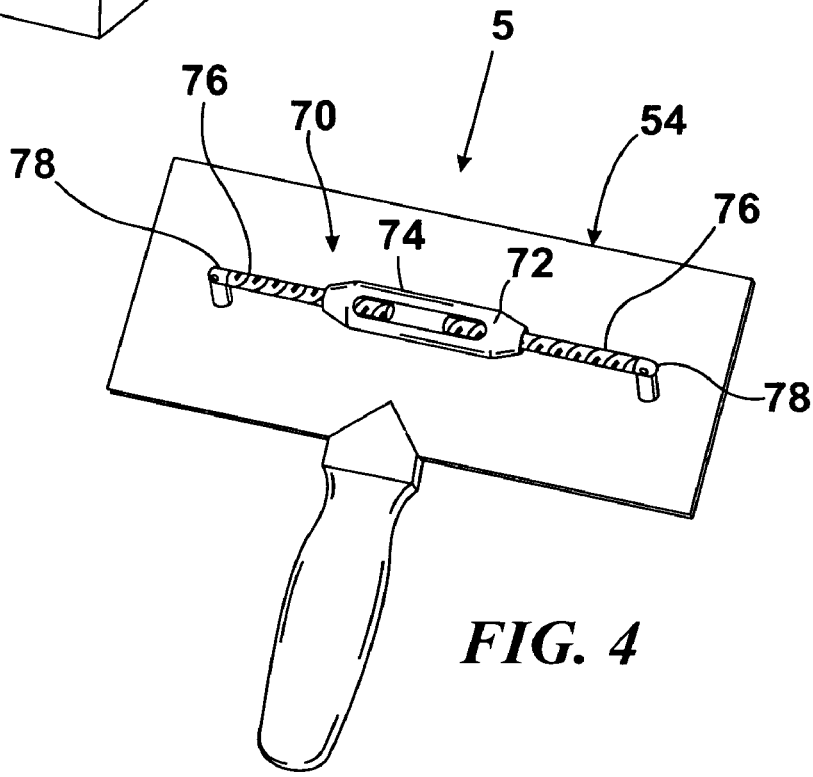
FIG. 4 is an enlarged diagrammatic perspective view of the area generally enclosed by the dotted curve identified by ARROW 4 in FIG. 3 of the first embodiment of the adjustable spatula of the present invention.
Figure 5:
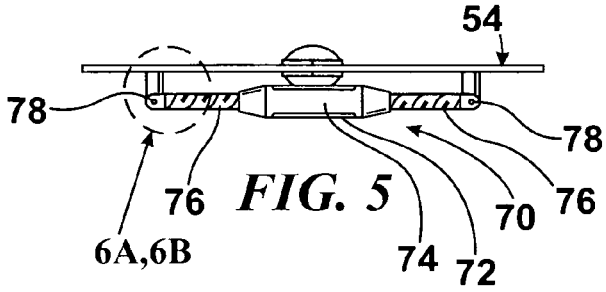
FIG. 5 is a diagrammatic top view taken generally in the direction of ARROW 5 in FIG. 4.
Figure 6A:
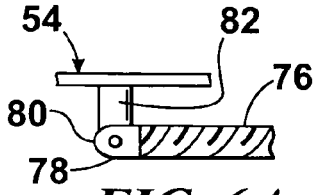
FIG. 6A is an enlarged diagrammatic top view of the area enclosed by the dotted curve identified by ARROW 6A in FIG. 5 of a variant of the first embodiment of the adjustable spatula of the present invention.
Figure 6B:
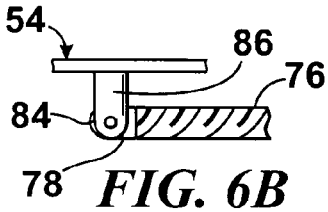
FIG. 6B is an enlarged diagrammatic top view of the area enclosed by the dotted curve identified by ARROW 6B in FIG. 5 of another variant of the first embodiment of the adjustable spatula of the present invention.
Figure 7:
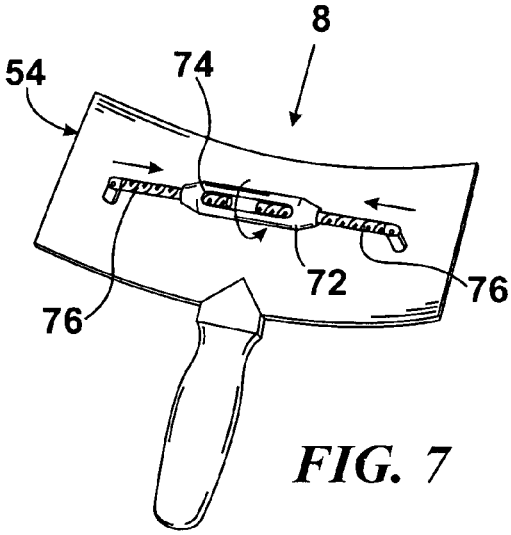
FIG. 7 is a diagrammatic perspective view of the first embodiment of the adjustable spatula of the present invention adjusted to form a smoothly arcuate concave contour in a viscous material.
Figure 9:
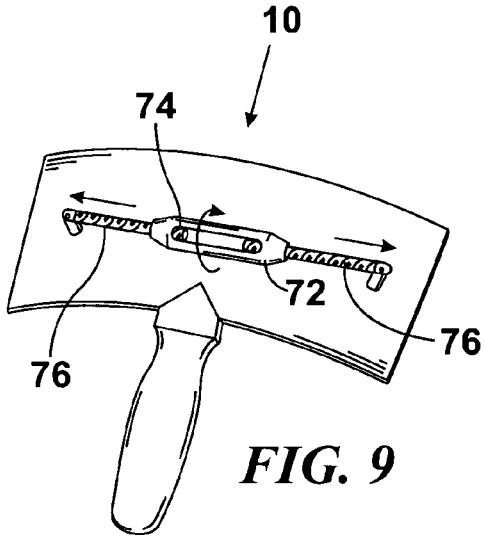
FIG. 9 is a diagrammatic perspective view of the first embodiment of the adjustable spatula of the present invention adjusted to form a smoothly arcuate convex contour in a viscous material.

The specific configuration of the first embodiment of the apparatus 70 can best be seen in FIGS. 4-10, which are, respectively, an enlarged diagrammatic perspective view of the area generally enclosed by the dotted curve identified by ARROW 4 in FIG. 3 of the first embodiment of the adjustable spatula of the present invention, a diagrammatic top view taken generally in the direction of ARROW 5 in FIG. 4, an enlarged diagrammatic top view of the area enclosed by the dotted curve identified by ARROW 6A in FIG. 5 of a variant of the first embodiment of the adjustable spatula of the present invention, an enlarged diagrammatic top view of the area enclosed by the dotted curve identified by ARROW 6B in FIG. 5 of another variant of the first embodiment of the adjustable spatula of the present invention, a diagrammatic perspective view of the first embodiment of the adjustable spatula of the present invention adjusted to form a smoothly arcuate concave contour in a viscous material, a diagrammatic top view taken generally in the direction of ARROW 8 in FIG. 7, a diagrammatic perspective view of the first embodiment of the adjustable spatula of the present invention adjusted to form a smoothly arcuate convex contour in a viscous material, and a diagrammatic top view taken generally in the direction of ARROW 10 in FIG. 9, and as such, will be discussed with reference thereto.

As shown in FIGS. 4 and 5, the apparatus 70 includes a turnbuckle 72. The turnbuckle 72 extends transversely across the blade 54, and has a sleeve 74 and a pair of threaded rods 76. The pair of threaded rods 76 of the turnbuckle 72 are oppositely threaded, extend threadably from the sleeve 74 of the turnbuckle 72, and terminate in ends 78 pivotally connected to the blade 54.

As shown in FIG. 6A, the ends 78 of the pair of threaded rods 76 of the turnbuckle 72 are bifurcated into devises 80. The devises 80 of the ends 78 of the pair of threaded rods 76 of the turnbuckle 72 pivotally receive pins 82, respectively, fixedly attached to the blade 54.

As shown in FIG. 6B, the ends 78 of the pair of threaded rods 76 of the turnbuckle 72 are halved into half-laps 84. The half-laps 84 of the ends 78 of the pair of threaded rods 76 of the turnbuckle 72 pivotally receive pins 86, respectively, fixedly attached to the blade 54.

Figure 8:
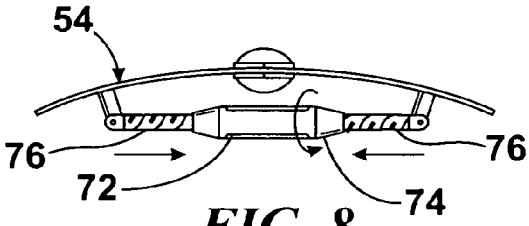
FIG. 8 is a diagrammatic top view taken generally in the direction of ARROW 8 in FIG. 7.

As shown in FIGS. 7 and 8, upon rotation of the sleeve 74 of the turnbuckle in one direction, the pair of threaded rods 76 of the turnbuckle 72 are caused to thread into the sleeve 74 of the turnbuckle 72, thereby decreasing their length, which pulls the blade 54 in causing the blade 54 to assume the smoothly arcuate convex contour for forming the smoothly arcuate concave contour in the viscous material 52.

Figure 10:
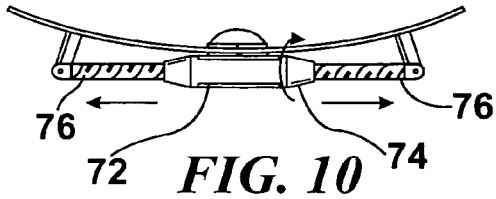
FIG. 10 is a diagrammatic top view taken generally in the direction of ARROW 10 in FIG. 9.

As shown in FIGS. 9 and 10, upon rotation of the sleeve 74 of the turnbuckle in an opposite direction, the pair of threaded rods 76 of the turnbuckle 72 are caused to thread out of the sleeve 74 of the turnbuckle 72, thereby increasing their length, which pushes the blade 54 out causing the blade 54 to assume the smoothly arcuate concave contour for forming the smoothly arcuate convex contour in the viscous material 52.

D. The Specific Configuration of a Second Embodiment of the Apparatus 90

Figure 11:
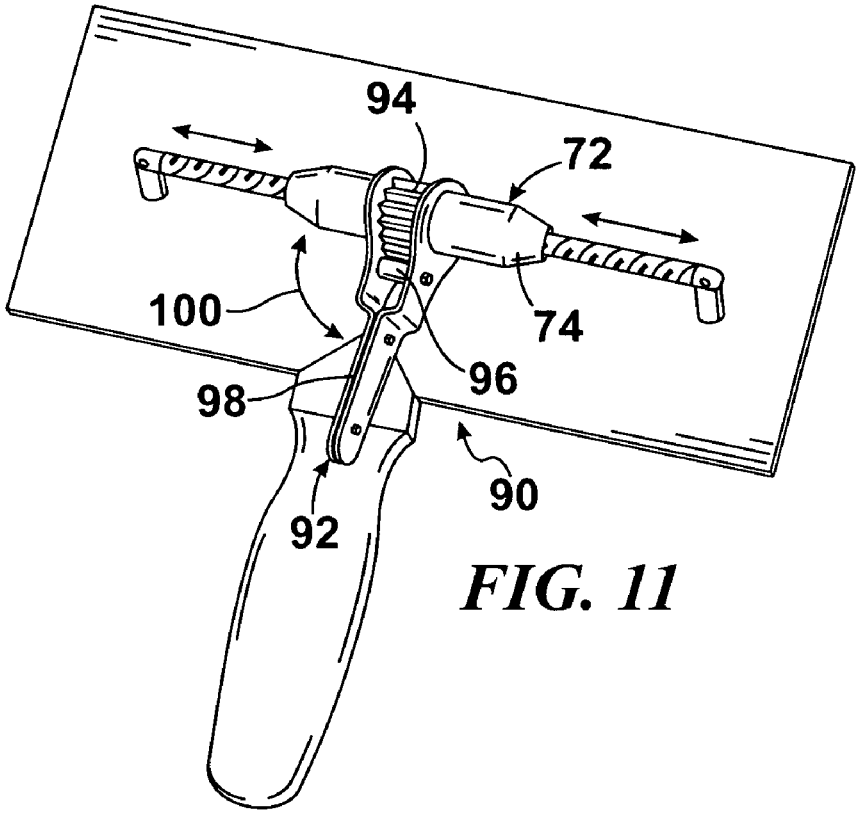
FIG. 11 is an enlarged diagrammatic perspective view of a second embodiment of the adjustable spatula of the present invention.
Figure 12:
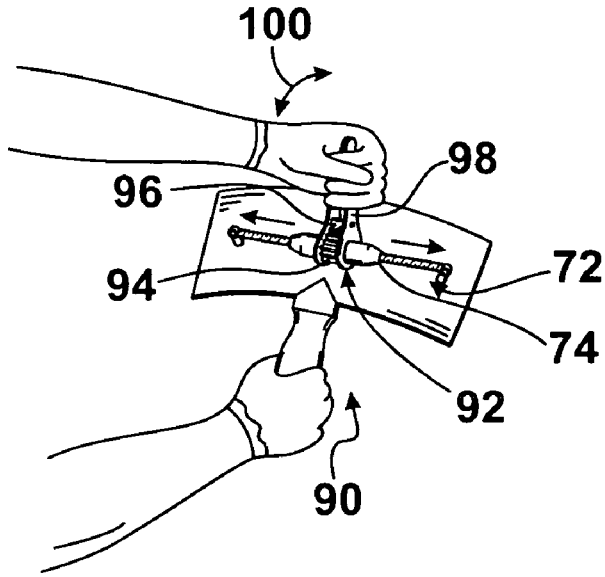
FIG. 12 is a diagrammatic perspective view of the second embodiment of the adjustable spatula of the present invention being adjusted.

The specific configuration of a second embodiment of the apparatus 90 can best be seen in FIGS. 11 and 12, which are, respectively, an enlarged diagrammatic perspective view of a second embodiment of the adjustable spatula of the present invention, and a diagrammatic perspective view of the second embodiment of the adjustable spatula of the present invention being adjusted, and as such, will be discussed with reference thereto.

The apparatus 90 is ratchet-operated, and as such, includes a ratchet 92 operatively connected to the turnbuckle 72. The ratchet 92 includes a head 94 with a pawl 96, and further includes a handle 98. The head 94 of the ratchet 92 is operatively connected to the sleeve 74 of the turnbuckle 72. The handle 98 of the ratchet 92 is operatively connected to the head 94 of the ratchet 92.

The sleeve 74 of the turnbuckle 72 rotates in a direction depending upon position of the pawl 96 of the head 94 of the ratchet 92 when the handle 98 of the ratchet 92 is moved back-and-forth in the directions of arrow 100, to thereby facilitate rotation of the sleeve 74 of the turnbuckle 72.

E. The Specific Configuration of a Third Embodiment of the Apparatus 110

Figure 13:
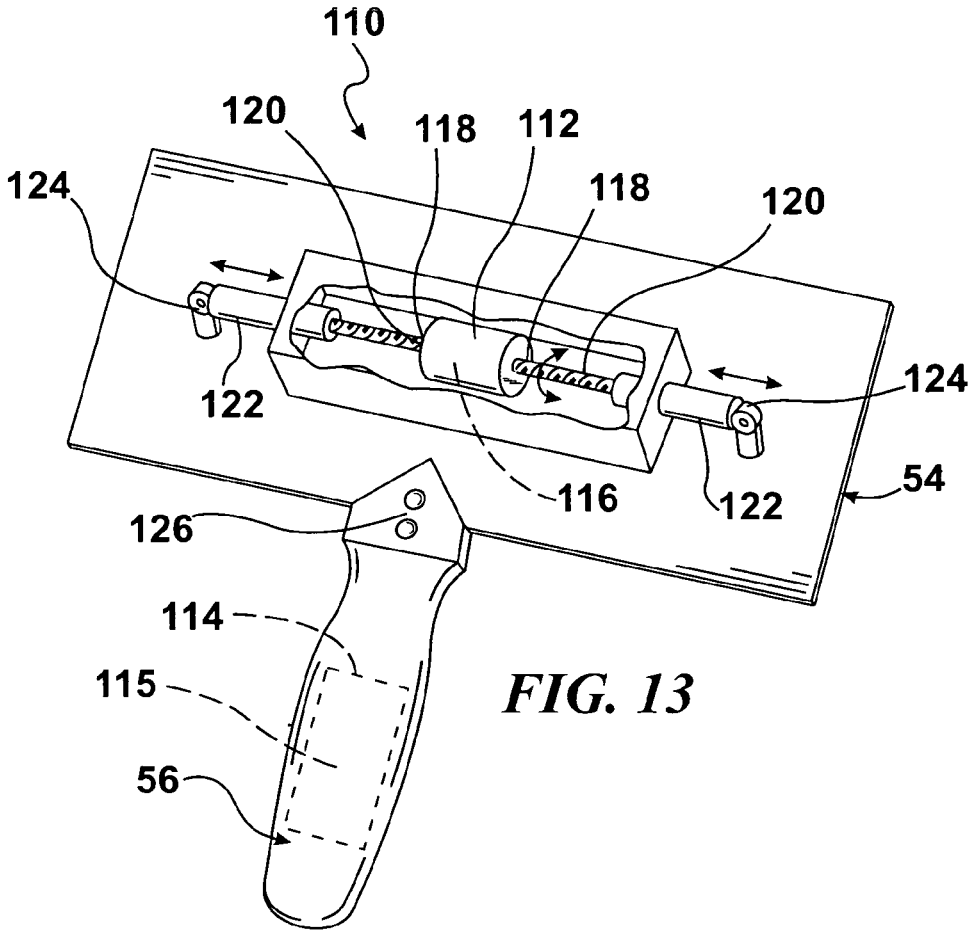
FIG. 13 is a diagrammatic perspective view of a third embodiment of the adjustable spatula of the present invention.

The specific configuration of a third embodiment of the apparatus 110 can best be seen in FIGS. 13 and 14, which are, respectively, a diagrammatic perspective view of a third embodiment of the adjustable spatula of the present invention, and a diagrammatic perspective view of the third embodiment of the adjustable spatula of the present invention being adjusted, and as such, will be discussed with reference thereto.

The apparatus 110 is motor-operated, and as such, includes a motor 112 operatively connected to the blade 54. The motor 112 extends transversely across the blade 54, is in electrical communication with a power interface 114 for holding at least one battery 115 disposed within the handle 56 for powering the motor 112, and has an armature 116 with a pair of ends 118.

The apparatus 110 further includes a pair of threaded rods 120 and a pair of internally threaded sleeves 122. The pair of threaded rods 120 are oppositely threaded, and extend coaxially from the pair of ends 118 of the armature 116 of the motor 112, respectively, to rotate therewith. The pair of internally threaded sleeves 122 threadably receive, and cooperate with, the pair of threaded rods 120, and terminate in ends 124 pivotally connected to the blade 54.

The apparatus 110 further includes at least one switch 126 operatively connected to, to selectively activate, the motor 112 in both directions, and is disposed on the handle where the handle 56 generally meets the blade 54 so as to be accessible by the thumb 128 of the user 60 gripping the handle 56.

Figure 14:
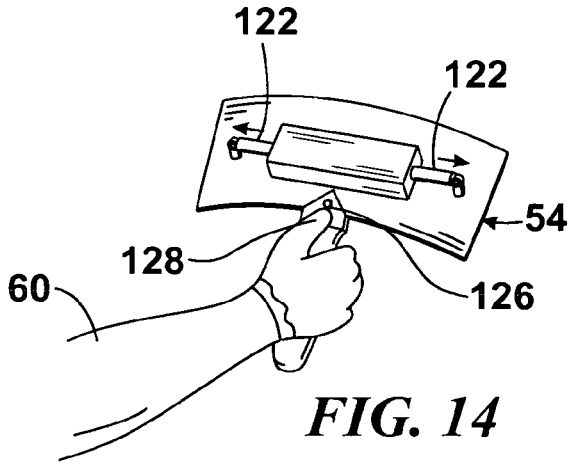
FIG. 14 is a diagrammatic perspective view of the third embodiment of the adjustable spatula of the present invention being adjusted.

As shown in FIG. 14, upon activating the at least one switch 126 to cause rotation of the armature 116 of the motor 112 in one direction, the pair of internally threaded sleeves 122 are caused to thread outwardly along the pair of threaded rods 120, thereby increasing their length, which pushes the blade 54 out causing the blade 54 to assume the smoothly arcuate concave contour for forming the smoothly arcuate convex contour in the viscous material 52.

Upon activating the at least one switch 126 to cause rotation of the armature 116 of the motor 112 in an opposite direction, the pair of internally threaded sleeves 122 are caused to thread outwardly along the pair of threaded rods 120, thereby increasing their length, which pushes the blade 54 in causing the blade 54 to assume the smoothly concave contour for forming the smoothly arcuate convex contour in the viscous material 52.

F. The Specific Configuration of a Fourth Embodiment of the Apparatus 130

Figure 15:
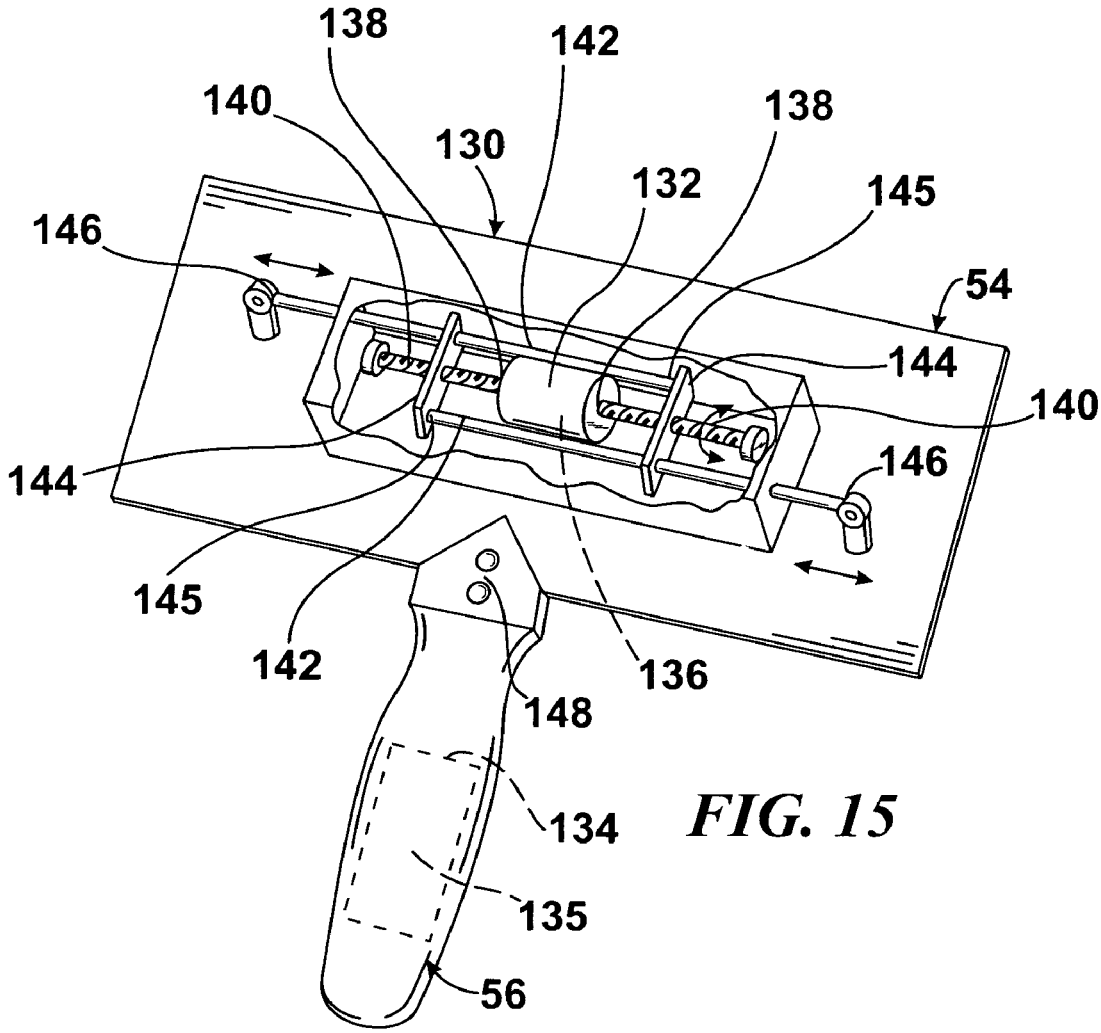
FIG. 15 is a diagrammatic perspective view of a fourth embodiment of the adjustable spatula of the present invention.

The specific configuration of a fourth embodiment of the apparatus 130 can best be seen in FIG. 15, which is a diagrammatic perspective view of a fourth embodiment of the adjustable spatula of the present invention, and as such, will be discussed with reference thereto.

The apparatus 130 is motor-operated, and as such, includes a motor 132 operatively connected to the blade 54. The motor 132 extends transversely across the blade 54, is in electrical communication with a power interface 134 for holding at least one battery 135 for powering the motor 132, is disposed within the handle 56, and has an armature 136 with a pair of ends 138.

The apparatus 130 further includes a pair of threaded rods 140 and a pair of rods 142. The pair of threaded rods 140 extend coaxially from the pair of ends 138 of the armature 136 of the motor 132, respectively, to rotate therewith, and are oppositely threaded.

The pair of rods 142 are operatively connected to the pair of threaded rods 140 via a pair of cross members 144, respectively, and have inner ends 145 affixed to the pair of cross members 144, respectively, and outer ends 146 pivotally connected to the blade 54. The pair of cross members 114 thread along the pair of threaded rods 140 carrying the pair of rods 142 therewith, respectively.

The apparatus 130 further includes at least one switch 148 operatively connected to, to selectively activate, the motor 132 in both directions, and is disposed on the handle where the handle 56 generally meets the blade 54 so as to be accessible by the thumb 128 of the user 60 gripping the handle 56.

Upon activating the at least one switch 148 to cause rotation of the armature 136 of the motor 132 in one direction, the pair of cross members 114 are caused to thread inwardly along the pair of threaded rods 142 carrying the pair of rods 142 therewith, respectively, which pulls the blade 54 in causing the blade 54 to assume the smoothly arcuate convex contour for forming the smoothly arcuate concave contour in the viscous material 52.

Upon activating the at least one switch 148 to cause rotation of the armature 136 of the motor 132 in an opposite direction, the pair of cross members 114 are caused to thread outwardly along the pair of threaded rods 142 carrying the pair of rods 142 therewith, respectively, which pushes the blade 54 out causing the blade 54 to assume the smoothly arcuate concave contour for forming the smoothly arcuate convex contour in the viscous material 52.

G. The Conclusions

It will be understood that each of the elements described above or two or more together may also find a useful application in other types of constructions differing from the types described above.

While the embodiments of the present invention have been illustrated and described as embodied in an adjustable spatula for forming a smoothly arcuate concave contour in a viscous material and a smoothly arcuate convex contour in the viscous material, independently of each other, with a certainty that the contour of the viscous material is consistent, and with using only one hand, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis, the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. An adjustable spatula for forming a smoothly arcuate concave contour in a viscous material and a smoothly arcuate convex contour in the viscous material, with a certainty that the contour of the viscous material is consistent, and with using only one hand, comprising:

a) a blade;

b) a handle; and c) means for bending said blade to form said blade into a smoothly arcuate convex contour to form the smoothly arcuate concave contour in the viscous material and for bending said blade to form said blade into a smoothly arcuate concave contour to form the smoothly arcuate convex contour in the viscous material, without a need for a user to have to manually bend said blade;

wherein said blade is broad, flat, thin, and extends coplanarly from said handle;

wherein said handle extends from said blade; and wherein said handle is for gripping by the user.

2. The spatula of claim 1, wherein said means for bending includes a turnbuckle; and wherein said turnbuckle extends transversely across said blade.

3. The spatula of claim 2, wherein said turnbuckle includes:

a) a sleeve; and b) a pair of threaded rods;

wherein said pair of threaded rods of said turnbuckle extend threadably from said sleeve of said turnbuckle;

wherein said pair of threaded rods of said turnbuckle terminate in ends; and wherein said ends of said pair of threaded rods of said turnbuckle are pivotally connected to said blade.

4. The spatula of claim 3, wherein said ends of said pair of threaded rods of said turnbuckle are bifurcated into clevises; and wherein said devises of said ends of said pair of threaded rods of said turnbuckle pivotally receive pins, respectively, fixedly attached to said blade.

5. The spatula of claim 3, wherein said ends of said pair of threaded rods of said turnbuckle are halved into half-laps; and wherein said half-laps of said ends of said pair of threaded rods of said turnbuckle pivotally receive pins, respectively, fixedly attached to said blade.

6. The spatula of claim 3, wherein upon rotation of said sleeve of said turnbuckle in one direction, said pair of threaded rods of said turnbuckle are caused to thread into said sleeve of said turnbuckle, thereby decreasing their length, which pulls said blade in causing said blade to assume a smooth arcuate convex contour for forming the smoothly arcuate concave contour in the viscous material; and wherein upon rotation of said sleeve of said turnbuckle in an opposite direction, said pair of threaded rods of said turnbuckle are caused to thread out of said sleeve of said turnbuckle, thereby increasing their length, which pushes said blade out causing said blade to assume a smooth arcuate concave contour for forming the smoothly arcuate convex contour in the viscous material.

7. The spatula of claim 3, wherein said means for bending is ratchet-operated, and as such, includes a ratchet; and wherein said ratchet is operatively connected to said turnbuckle.

8. The spatula of claim 7, wherein said ratchet includes:

a) a head; and b) a handle;

wherein said head of said ratchet has a pawl.

9. The spatula of claim 8, wherein said head of said ratchet is operatively connected to said sleeve of said turnbuckle;

wherein said handle of said ratchet is operatively connected to said head of said ratchet; and wherein said sleeve of said turnbuckle rotates in a direction depending upon position of said pawl of said head of said ratchet when said handle of said ratchet is moved back-and-forth, to thereby facilitate rotation of said sleeve of said turnbuckle.

10. The spatula of claim 1, wherein said means for bending is motor-operated, and as such, includes a motor;

wherein said motor is operatively connected to said blade;

wherein said motor extends transversely across said blade;

wherein said motor has an armature;

wherein said armature of said motor has pair of ends;

wherein said motor is in electrical communication with a power interface;

wherein said power interface is for holding at least one battery for powering said motor; and wherein said power interface is disposed within said handle.

11. The spatula of claim 10, wherein said means for bending includes:

a) a pair of threaded rods; and b) a pair of internally threaded sleeves;

wherein said pair of threaded rods extend coaxially from said pair of ends of said armature of said motor, respectively;

wherein said pair of threaded rods rotate with said pair of ends of said armature of said motor;

wherein said pair of threaded rods are oppositely threaded;

wherein said pair of internally threaded sleeves threadably receive said pair of threaded rods, respectively;

wherein said pair of internally threaded sleeves cooperate with said pair of threaded rods, respectively;

wherein said pair of internally threaded sleeves terminate in ends; and wherein said ends of said pair of internally threaded sleeves are pivotally connected to said blade.

12. The spatula of claim 11, wherein said means for bending includes at least one switch;

wherein said at least one switch is operatively connected to said motor;

wherein said at least one switch selectively activates said motor in both directions;

wherein said at least one switch is disposed on said handle, where said handle generally meets said blade so as to be accessible by the thumb of the user gripping said handle;

wherein upon activating said at least one switch to cause rotation of said armature of said motor in one direction, said pair of internally threaded sleeves are caused to thread inwardly along said pair of threaded rods, thereby decreasing their length, which pulls said blade in causing said blade to assume said smoothly convex contour for forming the smoothly arcuate concave contour in the viscous material; and wherein upon activating said at least one switch to cause rotation of said armature of said motor in an opposite direction, said pair of internally threaded sleeves are caused to thread outwardly along said pair of threaded rods, thereby increasing their length, which pushes said blade out causing said blade to assume said smoothly concave contour for forming the smoothly arcuate convex contour in the viscous material.

13. The spatula of claim 10, wherein said means for bending includes:

a) a pair of threaded rods; and b) a pair of rods;

wherein said pair of threaded rods extend coaxially from said pair of ends of said armature of said motor, respectively;

wherein said pair of threaded rods rotate with said armature of said motor; and wherein said pair of threaded rods are oppositely threaded.

14. The spatula of claim 13, wherein said pair of rods are operatively connected to said pair of threaded rods, via a pair of cross members, respectively;

wherein said pair of rods have inner ends;

wherein said inner ends of said pair of rods are affixed to said pair of cross members, respectively;

wherein said pair of rods have outer ends;

wherein said outer ends of said pair of rods are pivotally connected to said blade; and wherein said pair of cross members thread along said pair of threaded rods carrying said pair of rods therewith, respectively.

15. The spatula of claim 14, wherein said means for bending includes at least one switch;

wherein said at least one switch is operatively connected to said motor;

wherein said at least one switch selectively activates said motor in both directions;

wherein said at least one switch is disposed on said handle, where said handle generally meets said blade so as to be accessible by the thumb of the user gripping said handle;

wherein upon activating said at least one switch to cause rotation of said armature of said motor in one direction, said pair of cross members are caused to thread inwardly along said pair of threaded rods carrying said pair of rods therewith, respectively, which pulls said blade in causing said blade to assume said smoothly arcuate convex contour for forming the smoothly arcuate concave contour in the viscous material; and wherein upon activating said at least one switch to cause rotation of said armature of said motor in an opposite direction, said pair of cross members are caused to thread outwardly along said pair of threaded rods carrying said pair of rods therewith, respectively, which pushes said blade out causing said blade to assume said smoothly arcuate concave contour for forming the smoothly arcuate convex contour in the viscous material.

* * * * *